United States Patent [19]

Pardo

[11] Patent Number: 4,815,243

[45] Date of Patent: Mar. 28, 1989

[54] CONCRETE MASONRY BLOCK AND STUD WALL CONSTRUCTION SYSTEMS

[75] Inventor: Jorge Pardo, Reston, Va.

[73] Assignee: National Concrete Masonry Association, Herndon, Va.

[21] Appl. No.: 77,116

[22] Filed: Jul. 20, 1987

Related U.S. Application Data

[63] Continuation-in-part of Ser. No. 630,852, Jul. 13, 1984, Pat. No. 4,735,022.

[51] Int. Cl.[4] ..... E04C 1/00

[52] U.S. Cl. ..... 52/100; 52/144; 52/221; 52/405; 52/434; 52/609; 174/48

[58] Field of Search ..... 52/100, 144, 220, 221, 52/254, 255, 354, 355, 405, 408, 410–412, 415, 417–419, 424–427, 429–434, 562–565, 569–572, 506, 512, 609–611, 745, 746, 589–595, 605, 606; 174/48

[56] References Cited

U.S. PATENT DOCUMENTS

| | | | |
|---|---|---|---|
| 415,605 | 11/1889 | Blatchford . | |
| 710,830 | 10/1902 | Zimmermann et al. . | |
| 802,556 | 10/1905 | Depew et al. . | |
| 892,225 | 6/1908 | Collins . | |
| 1,267,747 | 5/1918 | Comerma . | |
| 1,325,249 | 12/1919 | Johnstone | 52/611 |
| 1,414,246 | 4/1922 | Ager | 52/100 |
| 1,428,470 | 9/1922 | Brainerd . | |
| 1,842,328 | 1/1932 | Giuliani . | |
| 1,885,496 | 11/1932 | Venzie . | |
| 1,921,518 | 8/1933 | Frobisher | 52/407 |
| 2,094,635 | 10/1937 | Brooks . | |
| 2,163,381 | 6/1939 | Marsan | 52/483 |
| 2,249,073 | 7/1941 | Williamson . | |
| 2,299,908 | 10/1942 | Leash . | |
| 2,951,318 | 9/1960 | Sedlak | 52/100 |
| 3,435,581 | 4/1969 | Ahlqvist . | |
| 3,998,014 | 12/1976 | Bartels et al. | 52/100 |
| 4,123,881 | 11/1978 | Muse | 52/100 |
| 4,124,062 | 11/1978 | Andersson et al. . | |
| 4,148,166 | 4/1979 | Toone . | |
| 4,241,782 | 12/1980 | Schoenfelder . | |
| 4,297,816 | 11/1981 | Kella et al. | 52/125 |
| 4,735,022 | 4/1988 | Pardo | 52/221 |

FOREIGN PATENT DOCUMENTS

| | | | |
|---|---|---|---|
| 163015 | 9/1948 | Austria . | |
| 910721 | 3/1954 | Fed. Rep. of Germany . | |
| 2844629 | 4/1979 | Fed. Rep. of Germany | 52/611 |
| 78922 | 8/1962 | France . | |
| 2316400 | 3/1977 | France | 52/220 |
| 2414595 | 9/1979 | France . | |
| 89501 | 6/1921 | Switzerland . | |
| 155054 | 6/1982 | Switzerland . | |

OTHER PUBLICATIONS

Engineering News Record, May 17, 1951, pp. 28 and 29, "Tilt-Up Block Walls Insulate Warehouse".

*Primary Examiner*—John E. Murtagh
*Assistant Examiner*—Andrew Joseph Rudy
*Attorney, Agent, or Firm*—Lowe, Price, LeBlanc, Becker & Shur

[57] ABSTRACT

The disclosed concrete masonry blocks are used as part of an interior wall by mounting the blocks between the studs and wall board. The concrete masonry blocks provide thermal storage capabilities. Preferred configurations of blocks are provided whereby electrical junction boxes, cables, etc., may installed within the stud wall frame end and wallboard. The blocks are preferably provided with normal thickness portions and reduced thickness ends with the latter defining a recess with the normal thickness portion enabling mounting of electrical junction boxes to a stud adjacent the block. In a preferred configuration, grooves formed within the reduced thickness portion adjacent the normal thickness portion of the block act as a score line enabling fracture of a part of the reduced thickness portion by application of external force thereto to enable a pair of electrical junction boxes to be mounted elevationally adjacent each other to a stud. To absorb high frequency sound and energy, a further improvement contemplates the use of caulking material disposed as a substantially continuous bead between adjacent rows of concrete block.

17 Claims, 2 Drawing Sheets

FIG. 2
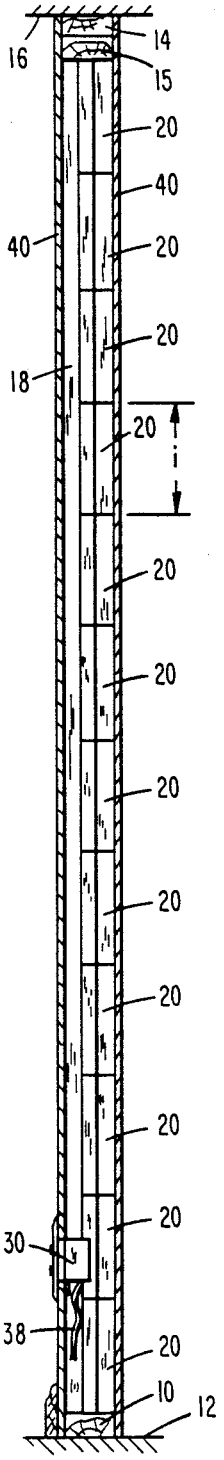
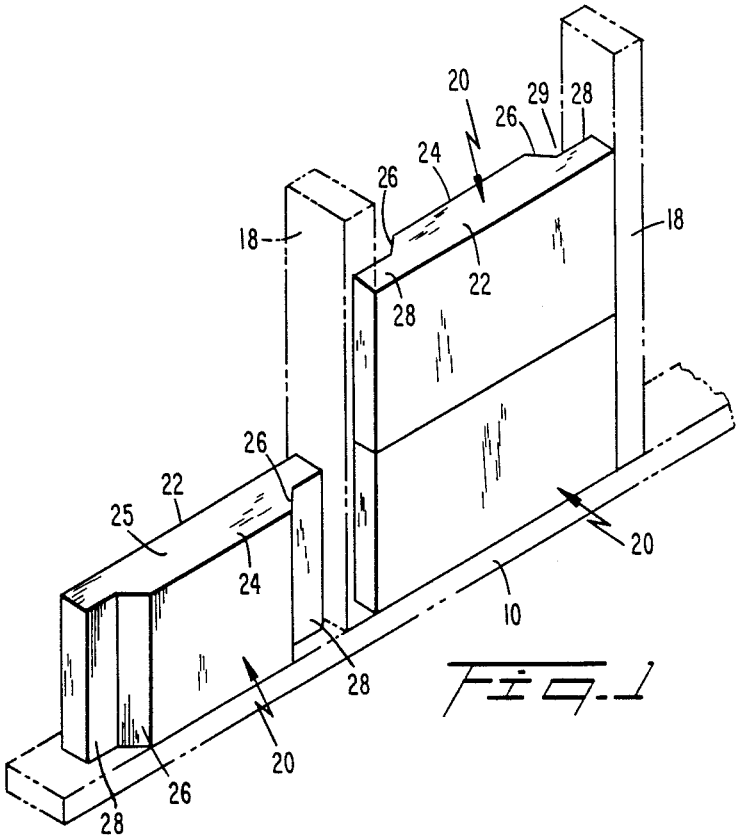
FIG. 1
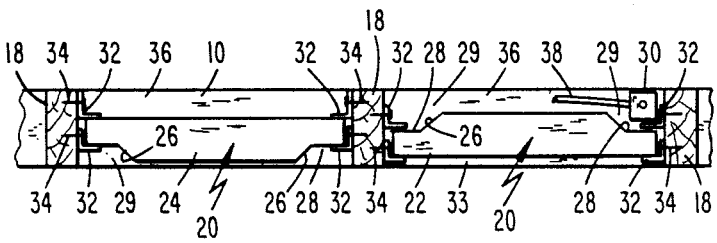
FIG. 3
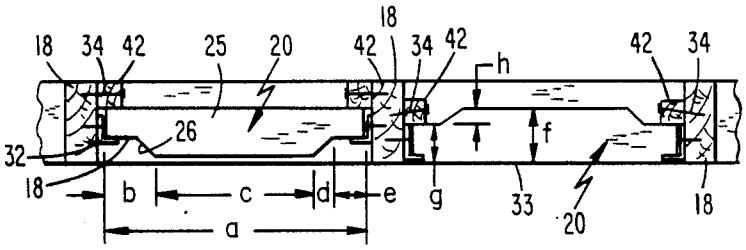
FIG. 4

CONCRETE MASONRY BLOCK AND STUD WALL CONSTRUCTION SYSTEMS

RELATED APPLICATIONS

The present application is a continuation-in-part of my co-pending U.S. patent application Ser. No. 630,852, filed July 13, 1984 now U.S. Pat. No. 4,735,022.

TECHNICAL FIELD

The present invention relates to certain types of stud wall constructions incorporating concrete masonry blocks which provide mass to improve thermal storage properties and provide heating improving characteristics including other advantages discussed below.

BACKGROUND ART

Reference is now made particularly to FIGS. 1–4 for the following description of a stud wall incorporating concrete masonry blocks according to the inventions disclosed in my aforesaid co-pending U.S. Patent Application. In FIGS. 1–4 there is shown part of such a wall section which includes a conventional stud wall frame construction comprising a base stud plate 10 extending along and secured to the floor 12 and a pair of upper stud plates 14 and 15 extending along and secured to the ceiling 16. A plurality of studs 18 extend vertically between, and are secured at their ends to, the floor stud plate 10 and the ceiling stud plates 14 and 15. In FIGS. 1–4, the floor stud plate, the ceiling stud plates, and the studs are shown to be made of wood; these members usually are $1\frac{1}{2}\times3\frac{1}{2}$ inches in cross-sectional size in the U.S. The studs 18 are spaced 16 inches on center according to standard U.S. practice A stud wall frame incorporating such members 10, 14, 15 and 18 is of conventional type and the construction thereof will be apparent to those in the art from the description herein.

The configuration of the concrete masonry blocks for use in the stud wall construction of FIGS. 1–4 will be apparent from examination of FIGS. 1–3 to which reference is now made. Concrete masonry blocks indicated generally by arrow 20 are of a modified substantially rectangular parallelepiped shape as shown in FIGS. 1 and 3. Each block 20 has a first section 22 extending the overall length of the block, and a second shorter section 24. The second shorter section 24 has two end surfaces 26 disposed at an angle to end block portions 28 which constitute the ends of said first block section 22. Thus, CM bock 20 has a main central portion 25 of major thickness including the thickness of both section 22 and 24 (shown at f in FIG. 4), plus end portions 28 of reduced thickness (shown at g in FIG. 4 discussed below). In a sense, CM block 20 may be considered as comprising a trapezoidal portion 24 extending laterally from and along the central part of a rectangular portion 22. This configuration of block 20 provides offsets or recesses 29 adjacent ends 28 of block 20; and such recesses 29 will accommodate installation of electrical junction boxes within the stud wall framing as shown at 30 in FIG. 3. Also, the angles surfaces 26 and recesses 29 near the ends of blocks 20 enable driving nails into the studs 18 and otherwise facilitate working in the space between adjacent studs and blocks 20 which have been disposed between the studs. A shown in FIG. 3, the blocks 20 are secured to the studs 18 by a plurality of metal angle strips 32 held in place by nails 34. Preferably the block retaining strips 32 are of a length equal to 3 or 4 times the height of CM blocks 20 to hold in place 3 or 4 vertically stacked blocks 20 to avoid toppling during installation. Also the block retaining strips 32 are designed so they may be applied on both sides of the blocks 20 in seismic area, or may be applied to one side of the blocks 20 in non-seismic areas.

The CM blocks 20 are disposed near one longitudinally extending edge 33 of the floor base plate 10 whereby the Cm blocks 20 are assembled within the stud wall along one side of the wall. This provides a space or cavity such as indicated at 36 along the other side of the stud wall to accommodate electrical conduits such as illustrated at 38 as well as junction boxes 30 and the like items which are used in conventional stud wall frame construction Referring to FIGS. 1 and 2 particularly, a vertical series of blocks 20 are stacked one on top of the other between the floor base plate 10 and the ceiling plates 14 and 15 within the space between adjacent studs 18. Wallboard shown at 40 is applied on both sides of the stud wall framing to enclose the wall in like manner as is done with conventional stud walls.

Referring to FIG. 4, the embodiment disclosed therein is substantially like that of the embodiment of FIG. 3 described above, and the like numerals are used in FIG. 4 for like parts as in FIGS. 1–3. FIG. 4 illustrates that the CM blocks 20 may be held in place by wooden strips shown at 42 nailed into studs 18 by nails 34. As shown in FIG. 4, wooden strips 42 may also be used with metal strips 32. Wooden strips 42 may be of a length 3 or 4 times the height of CM blocks 20 to hold in place 3 or 4 vertically stacked blocks 20.

The CM blocks 20 may be mechanically installed in a stud wall using either metal strips 32 or wood strips 42 in the manner described without the use of mortar and without a skilled bricklayer or mason. If necessary or desirable, the CM blocks 20 may also be removed and are reusable due to their mechanical installation.

The block and stud wall construction system described above is possessed of numerous advantages over other systems of which I am aware, one such advantage being the ability to assembly such walls with unskilled labor resulting in a mechanically, dry stack block system for installation in stud wall constructions. Another advantage achieved with the above system is the capacity to store thermal energy in interior walls of buildings by virtue of the high mass, high coverage characteristics of the blocks.

While the aforesaid blocks form an ideal sound barrier particularly effective in the low frequency range, the fact that these blocks are dry stacked on each other has resulted in the loss of heat and transmission of sound particularly high frequency sound, through the horizontal edges of the stacked blocks which essentially abut each other in stacking engagement.

In certain types of installations, it has proven necessary to install two single electrical junction boxes back-to-back (i.e., elevationally adjacent each other) to a stud. However, the reduced thickness portions 28 extended coextensive with he hick portions 25 the full height of the block frustrates the ability to mount the second junction box adjacent the first junction box.

SUMMARY OF THE INVENTION

It is accordingly one object of the present invention to provide the disclosed concrete masonry blocks with a novel modification to enable the new CM blocks and the shape of their reduced thickness portions to be easily modified at the work site so as to enable two single electrical junction boxes to be mounted back-to-back to each other adjacent the shaped reduced thickness portion.

Another object of the present invention is to provide a new CM block that may be easily manufactured without any significant modifications to the equipment used for manufacturing the disclosed CM blocks supra.

Another primary object of the present invention is to provide further novel modifications to existing lightweight stud wall construction systems wherein the concrete masonry blocks are secured together in a manner further preventing heat loss through the wall and with improved sound absorption capabilities.

The above and other related objects and advantages of the present invention will become apparent from the following description and specification, appended claims and drawings.

The concrete masonry block and stud wall system according to the present invention comprises a stud wall frame construction including a plurality of laterally spaced studs which extend vertically between a floor and a ceiling. A plurality of concrete masonry blocks are disposed between the studs with the blocks being stacked vertically between floor and ceiling. At east of the substantially rectangular blocks has at one end thereof a recess providing a portion of reduced thickness (R) in the block near the end adjacent a portion of normal thickness (N) of the block, wherein $R<N$. The reduction in thickness (R minus N) of the block is sufficient to accommodate an electrical junction box so that the box is disposed substantially entirely within the recess to allow wallboard to be applied to the studs.

The concrete block having the reduced thickness portion, in accordance with the present invention, further includes a groove formed in the reduced thickness portion and which groove extends adjacent the normal thickness portion to establish a score line to initiate fracture of a part of the reduced thickness portion upon application of external force thereto, leaving a remaining part of the reduced thickness portion in tact. The resulting modification in the reduced thickness portion enables a pair of electrical junction boxes to be mounted back-to-back or elevationally adjacent each other to a stud.

In further accordance with the present invention, the grooves provided on the reduced thickness portion are situated and have various characteristics described below which establish a reliable manner in which a portion of the reduced thickness portion may be optionally removed at the work site.

The stud wall and concrete masonry block constructions according to this invention can be readily constructed by dry mechanical assembly of the concrete masonry blocks by unskilled workers without mortar. The concrete masonry blocks are secured between and to the studs by wood strips and/or metal angles of suitable size. This eliminates the need for more expensive bricklayers or other masonry artisans. In fact, the installation of the blocks within such stud walls can be "do-it-yourself".

The concrete masonry blocks (sometimes called "CM blocks") have a configuration so that when the blocks are installed between studs their configuration permits the installation and nailing of electrical junction boxes secured to the studs, and the running of cables or conduits within the cavity of the stud wall in which such CM blocks are installed.

The CM blocks also provide improved acoustical characteristics for stud walls incorporating same as herein disclosed.

Also such type of wall constructions can be used to retrofit to existing stud walls. That would be done by simply removing one (or both) conventional wallboard surfaces, and proceeding in a manner as discussed herein.

The disclosed concrete masonry blocks for use in said stud wall construction disclosed in the drawings and described below can be made with standard existing equipment by ready modification of conventional concrete block machine molds. This is an important advantage for commercialization of these inventions.

The concrete masonry block constructions and configurations thereof within the stud wall have excellent thermal energy storage and acoustical insulation characteristics. However, as a result of extensive experimentation of the blocks and sound transmission loss capability, it has been determined that high frequency noise (i.e., approximately greater than 2000 CSP) tends to pass through the stud wall system of the invention. In accordance with a further feature of the invention, it has been discovered that all high frequency noise passthrough may be eliminated by providing a continuous bead of caulk or light resilient material between adjacent stacked edges of the concrete masonry blocks to enhance sound absorption characteristics.

BRIEF DESCRIPTION OF THE DRAWINGS

FIG. 1 is a perspective view of part of a conventional lightweight stud wall which however incorporates concrete masonry blocks between the studs and within the usual wallboard in a construction according to the present invention;

FIG. 2 is a partly side elevation and partly vertical sectional view of a stud wall frame wall incorporating a plurality of concrete masonry blocks stacked on top of each other from the floor to the ceiling using the CM blocks and stud wall arrangement shown in FIGS. 1, 3 and 4;

FIG. 3 is a partly top plan and partly sectional view of part of a stud wall construction shown in FIGS. 1 an 2 with the CM blocks held in place by metal angles nailed to the studs and with an electrical junction box and cable illustrated;

FIG. 4 is a partly top plan and partly sectional view of part of a stud wall construction shown in FIGS. 1–2 in which the CM blocks are secured to the studs by wood strips and metal angle strips;

BEST MODE FOR CARRYING OUT THE INVENTION

Figure 5:
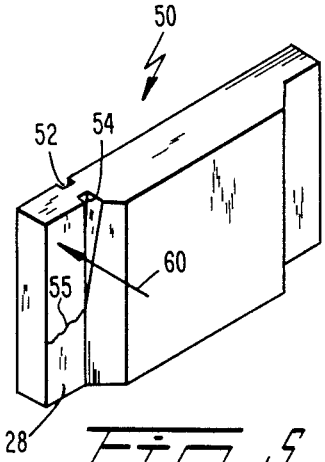
FIG. 5 is a perspective view of an improved CM block constructed in accordance with the principles of the present invention.
Figure 9:
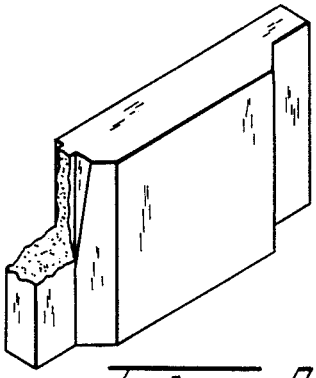
FIG. 9 is a view corresponding to FIG. 5 with a part of the reduced thickness removed in accordance with the present invention.

FIG. 5 is a perspective view of a CM block 50 which is essentially similar to the CM block 20 disclosed in my aforesaid co-pending U.S. patent application. However, in accordance with the present invention, CM block 50 further comprises a front and rear groove 52 and 54, respectively, which essentially define a score line 55 to initiate fracture of the reduced thickness portion 28 as depicted in FIG. 9. By application of external force (e.g., with a hammer) in the direction 60 of FIG. 5 and against the part of the reduced thickness portion extending coextensively with the groove 50, this part of the reduced thickness portion fractures and breaks away so that the resulting construction depicted in FIG. 9 may be employed in the manner disclosed in FIG. 10. Advantageously, therefore, the improved CM block 50 of the invention enables a pair of single electrical junction boxes 61*a* and 61*b* to be mounted back-to-back to stud 18 while a remaining part 62 of the reduced thickness portion remains within the confines of wooden strips 42 or other track means (e.g., metal strips 32) such as disclosed in FIGS. 3 and 4.

Figure 6:
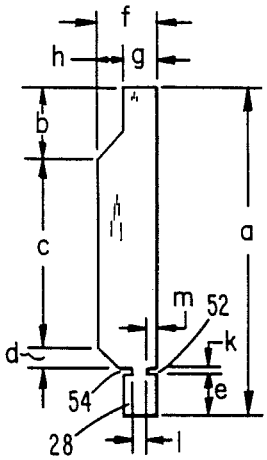
FIG. 6 is a top plan view of the improved block of FIG. 5.
Figure 7:
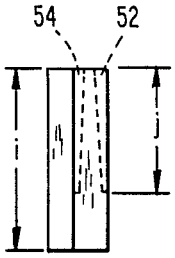
FIG. 7 is an end plan view of the block of FIG. 5.
Figure 8:
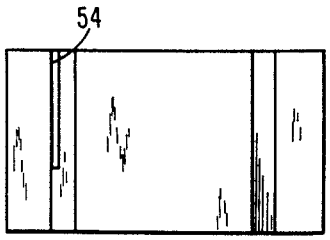
FIG. 8 is a side elevational front view of the block of FIG. 5.

FIGS. 6–8 are various detailed views of the improved CM block 50 according to the present invention to depict various structural specifics of the front and rear grooves. From FIGS. 5 and 7, it will be seen that the front and rear grooves are each preferably tapered so as to enable the CM blocks to be molded in the manner of manufacturing CM blocks disclosed in my co-pending application. Thus, the taper of the front and rear grooves is slight (e.g., approximately 3) to break the vacuum enabling easy release from the mold.

Figure 10:
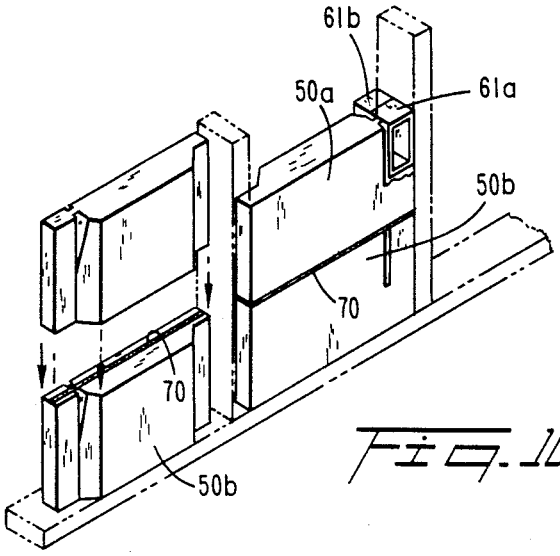
FIG. 10 is a view somewhat similar to FIG. 1 with the wall constructed with the improved bock of FIG. 5 and showing further improvements to the wall system of the present invention.

Reference is made particularly to FIG. 4 and also FIG. 2 wherein dimensional relationships of portions of a CM block 20 are indicated by letters (a)–(i). In an illustrative suitable commercial embodiment, the dimensions of various components of block 20 would be as follows:

- dimension a of overall length of block 20 is 14 inches;
- dimension b of the length of end portion 28 plus sloping portion 26 is 3 inches;
- dimension c of the center portion of the trapezoidal portion of block 20 is 8 inches;
- dimension d of the linear extent of sloping section 26 is 1 inch;
- dimension e of the linear length of end section 28 is 2 inches;
- dimension f of the overall thickness of block 20 is $2\frac{5}{8}$ inches;
- dimension g of the thickness of the end sections 28 is $1\frac{1}{2}$ inches;
- dimension h (the difference between dimension f and dimension g) is $1\frac{1}{8}$ inches;
- dimension i of the height of the block (indicated at i in FIG. 2) is $7\frac{5}{8}$ inches;
- dimension j is the height of the front and rear grooves of the block which is 5 inches;
- dimension k is the groove width which is $\frac{1}{4}$ inch;
- dimension 1 is the amount of concrete material remaining between the front and rear grooves which is $\frac{3}{4}$ inch which concrete material must be broken through to initiate fracture; and
- dimension m is the depth of each front and rear groove which is $\frac{3}{8}$ inches Referring to FIG. 10, another improvement feature of the present invention is disclosed, namely the provision of a caulking bead 70 disposed within each joint formed between upper and lower stacked blocks 50*a* and 50*b* by placement of the caulking bead on the upper edge exposed surface of the lower block 20*a* (e.g., by using a conventional caulking gun and conventional caulking materials) prior to mounting thereupon of the upper block 50*b*. By extensive experimentation, it has been discovered that the provision of the caulking bead 75 in the joints in the aforesaid manner greatly enhances the sound attenuation characteristics of blocks 50 of the present invention (or blocks 20 of my co-pending application) by absorption of high frequency noise (as the term is used herein high frequency noise being on the order of approximately 2000 CPS or higher). Although the mass of CM blocks 20 or 50 effectively prevents sound in the lower frequency spectrums from penetrating through the mass of the CM blocks, high frequency sound as aforesaid was found to pass through the joints formed between adjacent stacked blocks. The provision of the caulking bead 75 virtually eliminates any pass-through of high frequency noise.

The invention may be embodied in other specific forms without departing from the spirit or essential characteristics thereof. The present embodiments are, therefore, to be considered in all respects as illustrative and not restrictive, the scope of the invention being indicated by the appended claims and all changes which come within the meaning and range of equivalency of the claims are, therefore, intended to be embraced therein.

What is claimed is:

1. A concrete masonry block and stud wall comprising:

a stud frame construction including a plurality of laterally spaced studs which extend vertically between a floor and a ceiling;

a plurality of concrete masonry blocks having a substantially rectangular shape disposed between pairs of adjacent spaced studs with said blocks being stacked vertically between floor and ceiling, at least one of said substantially rectangular blocks having at one end thereof a recess providing a portion or reduced thickness g in the block near said end adjacent a portion of normal thickness f of said block, wherein $g<f$, the reduction in thickness (g–F) of said block being sufficient to accommodate an electric junction box so that said box is disposed substantially entirely within said recess to allow wallboard to be applied to the studs, said at least one rectangular block further including a groove means formed in the recess in the portion of reduced thickness and which groove means extends adjacent the normal thickness portion to establish a score line to initiate fracture of a part of said reduced thickness portion upon application of external force thereto leaving a remaining part of said reduced thickness portion in tact with the normal thickness portion of the block, thereby enabling a pair of electrical junction boxes to be mounted adjacent each other to a stud in a common elevation with one of said junction boxes occupying a space directly above said remaining part.

2. The wall of claim 1, wherein a maximum thickness of each of said concrete masonry blocks is less than the width of the studs by a sufficient amount so that when one side of the concrete masonry blocks is installed substantially in line with one edge of the studs there is sufficient room for installation of electrical cable and the like between the other side of said stacked concrete masonry blocks and wallboard installed on said stud on said other side of said blocks.

3. The wall of claim 2, further including a plurality of strips secured to the inside of adjacent studs and abutting opposite ends of said blocks on at least one side of said blocks to secure said blocks in said stud wall framing.

4. The wall of claim 3, wherein said plurality of strips is secured to said studs on two opposite side of said vertically stacked blocks and at both ends of said vertically stacked blocks.

5. The wall of claim 4, further comprising said wallboard secured to opposite sides of said studs enclosing said concrete masonry blocks stacked between adjacent studs.

6. The wall of claim 1, wherein said groove means includes a pair of grooves formed generally parallel to each other in opposing faces of the reduced thickness portion.

7. The wall of claim 6, wherein said grooves extend from one edge of the block a predetermined distance j which is less than the height i of said block.

8. The wall of claim 7, wherein the ratio of j to i is approximately two-thirds.

9. The wall of claim 8, wherein the height of said at least one block is in the approximate range of $7\frac{1}{2}$ to $7\frac{3}{4}$ inches and the length j of said grooves is approximately 5 inches.

10. The wall of claim 7, wherein said grooves are tapered and have maximum depths at said edge.

11. The wall of claim 10, wherein the amount of concrete material between the grooves proximate said edge has a thickness of approximately $\frac{3}{4}$ inch.

12. A concrete masonry block for installation in a stud wall frame construction including a plurality of laterally spaced studs which extend vertically between a floor and a ceiling, said block comprising:

a concrete masonry block made of cementitious material and having a substantially rectangular parallelepiped shape, said block having at each end thereof a portion of reduced thickness providing a recess in the block near each end thereof, said block including two surfaces extending at an angle between a main thicker portion of said block and said block end portions of reduced thickness which provide said recess in each end of said block; and groove means formed in the recess in the portion of reduced thickness and which groove means extend adjacent the thicker portions of said block adjacent the angle surfaces to thereby define a score line to initiate fracture of a part of said reduced thickness portion upon application of external force thereto leaving a remaining part of said reduced thickness portion in tact with the thicker portions, thereby enabling a pair of electrical junction boxes to be mounted elevationally adjacent each other to a stud.

13. The block of claim 12, wherein said groove means includes a pair of grooves formed generally parallel to each other in opposing faces of the reduced thickness portions.

14. The block of claim 13, wherein said grooves extend from one end of the block a predetermined distance j which is less than the height i of said block.

15. The block of claim 14, wherein one of said grooves formed in each reduced thickness portion includes a groove side wall formed in the angle surface of the block.

16. A concrete masonry block and stud wall comprising:

a stud wall frame construction including a plurality of laterally spaced studs which extend vertically between a floor and a ceiling:

a plurality of concrete masonry blocks each having a substantially rectangular parallelepiped shape disposed between pairs of adjacent spaced studs, with said blocks being stacked vertically between floor and ceiling;

each of said substantially rectangular blocks having at each end thereof a portion of reduced thickness providing a recess in the block near each end thereof;

a maximum thickness of each of said concrete masonry blocks being less than a width of the studs by a sufficient amount so that when one side of the concrete masonry blocks is installed substantially in line with one edge of the studs there is sufficient space for installation of electrical cable and the like between the other side of said stacked concrete masonry blocks and wallboard installed on said studs on said other side of said blocks;

the reduction in thickness at the end of each of the concrete masonry blocks and the recess thereby provided being sufficient to accommodate an electric junction box when wallboard is applied to the studs on said other side of said blocks;

and further including a layer of resilient caulking material and the like disposed as a substantially continuous bead between adjacent generally horizontal rows of said stacked concrete blocks for absorption of high frequency sound energy.

17. The concrete masonry block and stud wall according to claim 16, wherein said blocks have at one end thereof of said reduced thickness a groove means which groove means extends adjacent the thicker portions of the block to establish a score line between the thicker portions and reduced thickness portions to initiate fracture of a part of said reduced thickness portion upon application of external force thereto leaving a remaining part of said reduced thickness portion in tact, thereby enabling a pair of electrical junction boxes to be mounted elevationally adjacent each other to a stud within the wall.

* * * * *